US006224643B1

(12) United States Patent
Mungia

(10) Patent No.: US 6,224,643 B1
(45) **Date of Patent: *May 1, 2001**

(54) SELF-CONTAINED CHARCOAL STARTER

(76) Inventor: Jesse Mungia, P.O. Box 695, Gonzales, LA (US) 70707-0695

( * ) Notice: Subject to any disclaimer, the term of this patent is extended or adjusted under 35 U.S.C. 154(b) by 0 days.

This patent is subject to a terminal disclaimer.

(21) Appl. No.: 09/551,649

(22) Filed: Apr. 18, 2000

Related U.S. Application Data

(63) Continuation-in-part of application No. 09/150,548, filed on Sep. 9, 1998, now Pat. No. 6,080,214.

(51) Int. Cl.[7] ..... C10L 11/00
(52) U.S. Cl. ..... 44/530; 206/96
(58) Field of Search ..... 44/530; 206/96

(56) References Cited

U.S. PATENT DOCUMENTS

| | | | | |
|---|---|---|---|---|
| 179,165 | * | 6/1876 | Dalzell | 431/321 |
| 753,779 | * | 3/1904 | Woodman | 206/101 |
| 825,372 | * | 7/1906 | Beever | 206/102 |
| 1,418,217 | * | 5/1922 | Warner | 206/101 |
| 1,468,742 | * | 9/1923 | Peckes | 206/90 |
| 1,587,468 | * | 6/1926 | Burkey et al. | 206/269 |
| 1,835,749 | * | 12/1931 | Behrman | 150/106 |
| 2,537,332 | * | 1/1951 | Clampitt | 206/101 |
| 3,028,228 | * | 4/1962 | Chaplin | 44/530 |
| 4,108,611 | * | 8/1978 | Youdelman | 44/507 |
| 4,175,925 | * | 11/1979 | Paek et al. | 44/540 |
| 4,478,601 | * | 10/1984 | Stephens | 44/530 |
| 4,782,812 | * | 11/1988 | Kellerman | 44/530 |
| 4,899,721 | * | 2/1990 | Tsay | 126/25 B |
| 5,279,628 | * | 1/1994 | Hutchens et al. | 44/507 |
| 5,830,245 | * | 11/1998 | Raddon | 44/544 |
| 6,080,214 | * | 6/2000 | Mungia | 44/530 |

* cited by examiner

*Primary Examiner*—Ellen M. McAvoy
(74) *Attorney, Agent, or Firm*—Reginald F. Roberts, Jr.

(57) ABSTRACT

A self-contained charcoal starter for barbecuing. The self-contained charcoal starter provides a bag of charcoal briquettes which includes a box or book of matches for lighting the briquettes. The matches are in a smaller bag which is stitched to the bag of briquettes when the bag of briquettes is sewn shut during its manufacture. The user tears the bag of charcoal briquettes open, then proceeds to retrieve a match from the smaller bag, and uses the match to start the fire.

12 Claims, 1 Drawing Sheet

SELF-CONTAINED CHARCOAL STARTER

CROSS-REFERENCE TO RELATED APPLICATION

This application is a continuation-in-part of application Ser. No. 150,548, filed Sep. 9, 1998, now U.S. Pat. No. 6,080,214.

BACKGROUND OF THE INVENTION

The present invention relates to a barbecue pit. More particularly, the invention relates to a packet for igniting charcoal in a barbecue pit.

More often than not, a person intent on barbecuing hamburgers, chicken, or similar food is all ready to get started and then—forgets the matches! The present invention solves this problem by providing a packet which is sufficient, in and by itself, to start a barbecue fire.

U.S. Pat. No. 4,899,721 to Tsay discloses a charcoal stove casing set which is adapted for preparation of barbecue and for household fireplace application.

U.S. Pat. No. 825,372 to Beever discloses a combined match box and oil can adapted to be strapped to the waist of a miner.

U.S. Pat. No. 753,779 to Woodman discloses a glove to be worn while striking a match.

U.S. Pat. No. 1,418,217 to Warner discloses a match holder for hats.

U.S. Pat. No. 2,537,332 to Clampith discloses a watertight cigarette and match case.

U.S. Pat. No. 1,835,749 to Behrman discloses a lady's pocketbook for holding cigarette cases and a cigarette lighter.

U.S. Pat. No. 179,165 to Dalzell discloses a match-box attachment for lamps adapted to lighting the lamps.

U.S. Pat. No. 1,587,468 to Burkey et al. discloses a watertight case for holding cigarettes and matches.

U.S. Pat. No. 1,468,742 to Peckes discloses a watertight container for cigarettes, confections, chewing gum, and the like.

A kit sold as "CHARCOAL COMPANION" provides the purchaser with a barbecue grill and various sauces, but not with any means for starting a barbecue fire.

Thus, none of the prior art provides the public with a packet which is simple, accessible, and self-sufficient for the immediate preparation of a charcoal barbecue in a barbecue pit. The present invention provides such a packet.

SUMMARY OF THE INVENTION

In general, the present invention in a first aspect provides a self-contained charcoal starter comprising a first container; a second container having a first portion disposed within the first container, and having a second portion disposed exterior of the first container, the second container being fastened to the first container where the first and second portions of the second container contact one another; ignition means disposed within the first portion of the second container; and combustible material ignitable by the ignition means, the combustible material being disposed within the first container.

In a second aspect the invention provides a method for converting a bag of charcoal briquettes into a self-contained charcoal starter. The method comprises disposing in an open end of the bag a container having a first portion disposed within the bag, and a second portion disposed outside of the bag; disposing ignition means in the first portion of the container; and sealing the open end of the bag, and the bag and the container to one another.

In a third aspect the invention provides a self-contained charcoal starter comprising a first container having inside and outside surfaces; a second container stapled to the inside surface of the first container; ignition means disposed within the second container; and combustible material ignitable by the ignition means, disposed within the first container.

DETAILED DESCRIPTION OF THE INVENTION

Figure 1:
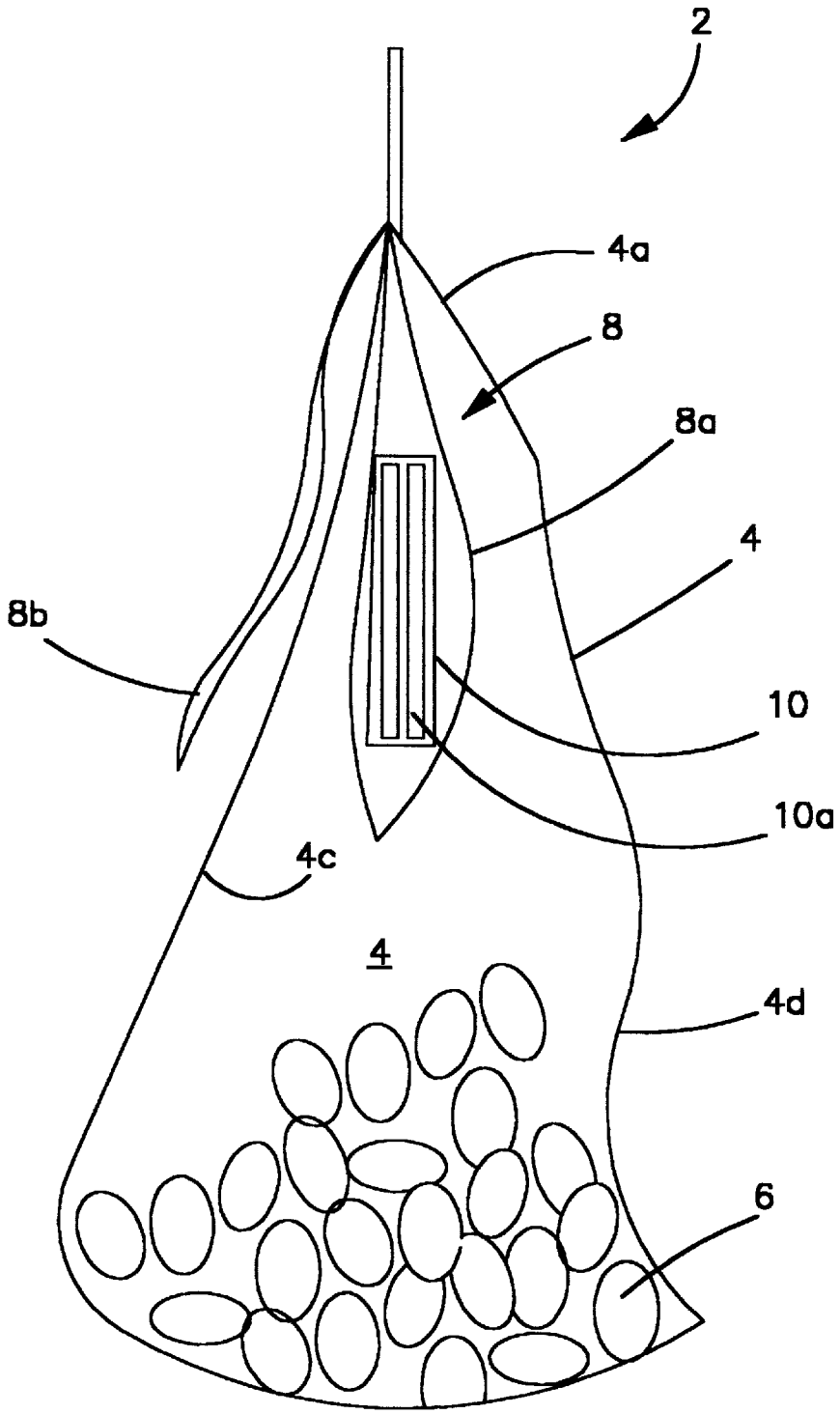
FIG. 1 is a schematic cross-sectional representation of a self-contained charcoal starter, made in accordance with the principles of the present invention.

More specifically, reference is made to FIG. 1, in which is shown, in cross-section, a self-contained charcoal starter, made in accordance with the principles of the present invention, and generally designated by the numeral 2.

The self-contained charcoal starter 2 comprises a large bag 4 holding a plurality of briquettes 6 containing charcoal. At the top 4*a* of the large bag 4 is a small bag 8. The large bag 4 is preferably a flexible bag made of paper or plastic, and the small bag 8 is preferably made of plastic.

In a first embodiment the small bag 8 includes a first portion which defines a pouch 8*a* disposed within the large bag 4, and a second portion defining a flap 8*b* which protrudes from the top 4*a* of the large bag 4.

A box or book 10 of matches 10*a* is disposed in the pouch 8*a*.

The top 4*a* of the large bag 4, which during fabrication was open, is sewed shut. Since the small bag 8 is disposed at the top 4*a* of the large bag 4, this operation results in sewing the large bag 4 and the small bag 8 to one another. The result is that the top 4*a* of the large bag 4 is sealed by stitching, and the large and small bags 4 and 8 are fastened to one another by stitching.

To start a barbecue fire, the large bag 4 is torn open. Some or all of the charcoal-containing briquettes 6 are then poured out into a barbecue pit. When the briquettes 6 are ready to be lit, a match 10*a* is retrieved from the match box or match book 10 by opening the pouch 8*a* and the match box or match book 10.

In a second embodiment the small bag 8 includes a first portion which defines a pouch 8*a* disposed within the large bag 4, and a second portion defining a flap 8*b*. The large bag 4 has inside and outside surfaces 4*c* and 4*d*, respectively. The flap 8*b* is stapled to the inside surface 4*c* of the large bag 4. In this embodiment the flap 8*b* need not protrude from the top 4*a* of the large bag 4.

A box or book 10 of matches 10*a* is disposed in the pouch 8*a*. The small bag 8 is disposed at or near the top 4*a* of the large bag 4. The large bag 4 may be closed and sealed by stitching, stapling, gluing, or the like.

The present invention thus provides simple, complete, and expeditious preparation for starting a charcoal fire. Mechanisms provided by the prior art are, by comparison, complex, cumbersome, slow, and inappropriate for the intended objective.

For example, Tsay teaches the use of a press-paper casing provided with a solid-alcohol trough and a match-stick fire assembly for his charcoal stove casing set. For his combined match box and oil can, Beever discloses a match box provided with a screw-threaded portion which is adapted to engage a screw-threaded portion of a socket. For his match box attachment for lamps, Dalzell uses a match box sunk within the bowl of a lamp. The match box forms a tight threaded joint with the collar of a filling orifice, and is provided with a hinged or screw cap.

It will be apparent to those skilled in the art that mechanisms such as those described above and disclosed by the prior art are unsuitable and impractical for a charcoal starter comprising a bag containing charcoal and a box or book of matches for igniting the charcoal.

While certain details and embodiments have been described to illustrate the principles of the present invention, it will be apparent to those skilled in the art that many modifications can and may be made therein without departing from the spirit, scope, and basic concept of the invention. For example, wood chips or small wooden logs, scented or unscented, are packaged and sold for use in fireplaces or for other applications. It will be apparent to those skilled in the art that the use of wood chips or wooden logs rather than charcoal-containing briquettes clearly lies within the scope of the present claimed invention.

I claim:

1. A self-contained charcoal starter, comprising:

(a) a first container;

(b) a second container having a first portion disposed within the first container, and having a second portion disposed exterior of the first container, the second container being fastened to the first container where the first and second portions of the second container contact one another;

(c) ignition means disposed within the first portion of the second container; and (d) combustible material ignitable by the ignition means, the combustible material being disposed within the first container.

2. The self-contained charcoal starter of claim 1, wherein:

the first container is a bag; and the ignition means include a match.

3. The self-contained charcoal starter of claim 1, wherein:

the first container is a bag;

the second container is a bag; and the second portion of the second container defines a flap protruding from the first container.

4. The self-contained charcoal starter of claim 1, wherein the second container is fastened to the first container by:

disposing the second container at an open end of the first container; and sealing the open end of the first container, and sealing the first and second containers to one another.

5. The self-contained charcoal starter of claim 4, wherein the sealing is by stitching.

6. The self-contained charcoal starter of claim 1, wherein the combustible material includes charcoal.

7. A method for converting a bag of charcoal briquettes into a self-contained charcoal starter, the method comprising the steps of:

(a) disposing in an open end of the bag a container having a first portion disposed within the bag, and a second portion disposed outside of the bag;

(b) disposing ignition means in the first portion of the container; and (c) sealing the open end of the bag, and the bag and the container to one another.

8. The method of claim 7, wherein the sealing is effected by stitching.

9. A self-contained charcoal starter, comprising:

(a) a first container having inside and outside surfaces;

(b) a second container stapled to the inside surface of the first container;

(c) ignition means disposed within the second container; and (d) combustible material ignitable by the ignition means, disposed within the first container.

10. The self-contained charcoal starter of claim 9, wherein:

the first container is a bag; and the ignition means include a match.

11. The self-contained charcoal starter of claim 9, wherein:

the first container is a bag; and the second container is a bag.

12. The self-contained charcoal starter of claim 9, wherein the combustible material includes charcoal.

* * * * *